US009785071B2

(12) United States Patent
Shimano et al.

(10) Patent No.: US 9,785,071 B2
(45) Date of Patent: Oct. 10, 2017

(54) TONER AND METHOD FOR PRODUCING TONER

(71) Applicant: CANON KABUSHIKI KAISHA, Tokyo (JP)

(72) Inventors: Tsutomu Shimano, Mishima (JP); Yoshihiro Nakagawa, Numazu (JP); Masatake Tanaka, Yokohama (JP); Naoya Isono, Suntou-gun (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/234,497

(22) Filed: Aug. 11, 2016

(65) Prior Publication Data

US 2017/0052465 A1 Feb. 23, 2017

(30) Foreign Application Priority Data

Aug. 21, 2015 (JP) ..... 2015-163399

(51) Int. Cl.
*G03G 9/087* (2006.01)
*G03G 9/093* (2006.01)
*G03G 9/08* (2006.01)

(52) U.S. Cl.
CPC ..... *G03G 9/08711* (2013.01); *G03G 9/0806* (2013.01); *G03G 9/09328* (2013.01); *G03G 9/09364* (2013.01); *G03G 9/09371* (2013.01); *G03G 9/09392* (2013.01)

(58) Field of Classification Search
CPC ..... G03G 9/08711; G03G 9/09328; G03G 9/09364; G03G 9/09371; G03G 9/09392
USPC ..... 430/110.2, 109.3
See application file for complete search history.

(56) References Cited

U.S. PATENT DOCUMENTS

| | | | |
|---|---|---|---|
| 6,569,589 | B2 | 5/2003 | Inaba et al. |
| 7,833,685 | B2 | 11/2010 | Tanaka et al. |
| 8,367,289 | B2 | 2/2013 | Isono et al. |
| 8,377,616 | B2 | 2/2013 | Tani et al. |
| 8,440,382 | B2 | 5/2013 | Isono et al. |
| 8,497,054 | B2 | 7/2013 | Sugiyama et al. |
| 8,603,712 | B2 | 12/2013 | Aoki et al. |
| 8,628,899 | B2 | 1/2014 | Kawamura et al. |
| 8,652,737 | B2 | 2/2014 | Handa et al. |
| 8,741,519 | B2 | 6/2014 | Watanabe et al. |
| 8,778,581 | B2 | 7/2014 | Nonaka et al. |
| 8,815,484 | B2 | 8/2014 | Tanaka et al. |
| 8,846,284 | B2 | 9/2014 | Kinumatsu et al. |
| 9,158,216 | B2 | 10/2015 | Shimano et al. |
| 9,377,705 | B2 | 6/2016 | Shimano et al. |
| 9,383,668 | B2 | 7/2016 | Noji et al. |
| 9,429,860 | B2 | 8/2016 | Kinumatsu et al. |
| 2010/0035171 | A1 | 2/2010 | Watanabe et al. |
| 2012/0045717 | A1 | 2/2012 | Hiroko et al. |
| 2014/0356779 | A1 | 12/2014 | Hasegawa et al. |
| 2015/0153666 | A1 | 6/2015 | Isono et al. |
| 2015/0153668 | A1 | 6/2015 | Tanaka et al. |
| 2015/0153669 | A1 | 6/2015 | Yoshida et al. |
| 2015/0177632 | A1 | 6/2015 | Imae et al. |
| 2015/0248071 | A1 | 9/2015 | Katsura et al. |
| 2015/0261110 | A1 | 9/2015 | Nakagawa et al. |
| 2015/0370189 | A1 | 12/2015 | Tanaka et al. |
| 2016/0246192 | A1 | 8/2016 | Yoshida et al. |
| 2016/0246195 | A1 | 8/2016 | Shimano et al. |

FOREIGN PATENT DOCUMENTS

| | | | |
|---|---|---|---|
| JP | 2006-106727 | A | 4/2006 |
| JP | 2011-197192 | A | 10/2011 |
| JP | 2012-255957 | A | 12/2012 |
| JP | 2015-121661 | A | 7/2015 |

OTHER PUBLICATIONS

U.S. Appl. No. 15/149,817, filed May 9, 2016.
U.S. Appl. No. 15/152,313, filed May 11, 2016.
U.S. Appl. No. 15/154,802, filed May 13, 2016.
U.S. Appl. No. 15/198,858, filed Jun. 30, 2016.
A.D. Jenkins, et al., "Glossary of Basic Terms in Polymer Science," Pure & Applied Chemistry, vol. 68, No. 12, (1996) 2287-311.

*Primary Examiner* — Mark A Chapman
(74) *Attorney, Agent, or Firm* — Fitzpatrick Cella Harper and Scinto

(57) ABSTRACT

The toner comprising a toner particle having a core-shell structure that contains a core containing an amorphous resin A and a crystalline resin and a shell containing an amorphous resin B, wherein the amorphous resin A contains a styrene-acrylic resin, the content of the styrene-acrylic resin is at least 50% by mass based on the total mass of the amorphous resin A, a degree of compatibility A between the amorphous resin A and the crystalline resin is at least 50% and not more than 100%, and a degree of compatibility B between the amorphous resin B and the crystalline resin is at least 0% and not more than 40%.

6 Claims, No Drawings

TONER AND METHOD FOR PRODUCING TONER

BACKGROUND OF THE INVENTION

Field of the Invention

The present invention relates to a toner used to form a toner image through the development of an electrostatic latent image that has been formed by a method such as electrophotography, electrostatic recording, and toner jet recording systems. The present invention further relates to a method for producing a toner.

Description of the Related Art

Lower energy consumption and improved toner performance have been required of printers and copiers in recent years. Specifically, there is demand to bring about toner softening at lower temperatures, but this cannot be achieved with an approach that simply causes toner softening due to the necessity at the same time to maintain the high-temperature storability. Toner that incorporates a crystalline resin has been investigated to respond to this problem. Crystalline resin has little effect on the high-temperature storability of toner because it is crystallized at room temperature, and can bring about toner softening due to a viscosity drop upon melting.

Japanese Patent Application Laid-open No. 2006-106727 proposes a toner in which lamellar crystals of a crystalline polyester are present in the surface layer and the interior of the toner.

At the same time, ever higher speeds are being required of printers and copiers. The stress applied to the toner is enhanced when the developing system is sped up, and this then requires a toner that is more stress resistant and that exhibits an excellent strength. Toners having a core-shell structure have been investigated in order to address this problem without impairing the aforementioned low-temperature fixability.

Japanese Patent Application Laid-open No. 2012-255957 proposes a toner having a core-shell structure, which contains a crystalline polyester and a styrene-acrylic resin as binder resins.

It is stated in Japanese Patent Application Laid-open No. 2011-197192 that, for a toner in which polyester resin is the major component, the compatibility between the shell material and crystalline polyester is low.

SUMMARY OF THE INVENTION

With the toner described in Japanese Patent Application Laid-open No. 2006-106727, the heat-resistant storability is strongly preserved due to the maintenance of the crystallinity of the crystalline polyester in the toner, and at the same time the toner readily undergoes collapse through liquefaction of the crystalline polyester during fixing and as a result the low-temperature fixability of the toner is improved. However, given the concept underlying this toner, it cannot be concluded that the effects from the addition of the crystalline polyester are fully exploited since the crystalline polyester and toner binder do not melt uniformly during fixing.

The toner described in Japanese Patent Application Laid-open No. 2012-255957 was not investigated from the standpoint of the compatibility between the shell material and the crystalline material, and as a consequence there is a risk that the toner surface will undergo a decline in viscosity due to the compatibility of the crystalline polyester. With such a structure, when the compatibility is raised in order to obtain effects due to the crystalline polyester, the strength of the toner declines and as a result it is quite difficult for the low-temperature fixability and the developing performance to co-exist.

With Japanese Patent Application Laid-open No. 2011-197192, the hydrophilicity of the shell material itself must be increased in order to obtain the aforementioned compatibility, and this results in a decline in the developing performance in high-humidity environments.

Thus, with regard to core-shell structured toner that incorporates a crystalline resin, a toner has yet to appear for which the compatibility between the crystalline resin and binder, and the compatibility between the crystalline resin and shell material are controlled and for which the effects of the crystalline resin are fully exploited.

The present invention provides a toner that solves the existing problems as described above. That is, the present invention has as an object the introduction of a toner that is capable of low-energy fixing, that has a satisfactory developing performance even in high-speed developing systems, and that can also maintain a satisfactory developing performance at high humidities.

The invention according to the present application is a toner comprising a toner particle having a core-shell structure that contains a core and a shell on the core, wherein the core contains an amorphous resin A and a crystalline resin, the shell contains an amorphous resin B, the amorphous resin A contains a styrene-acrylic resin, the content of the styrene-acrylic resin is at least 50% by mass based on the total mass of the amorphous resin A, a degree of compatibility A between the amorphous resin A and the crystalline resin, calculated with the following formula (X), is at least 50% and not more than 100%

$$\text{degree of compatibility } A\ (\%)=100-(100\times\Delta H(A))/(\Delta H(C)\times C/100) \quad \text{(X), and}$$

a degree of compatibility B between the amorphous resin B and the crystalline resin, calculated with the following formula (Y), is at least 0% and not more than 40%

$$\text{degree of compatibility } B\ (\%)=100-(100\times\Delta H(B))/(\Delta H(C)\times D/100) \quad \text{(Y),}$$

(wherein, in formulae (X) and (Y),

ΔH(A) represents an exothermic quantity (J/g) of an exothermic peak of a resin mixture A in differential scanning calorimetric analysis, the resin mixture A consisting of the amorphous resin A and the crystalline resin ΔH(C) represents an exothermic quantity (J/g) of an exothermic peak of the crystalline resin in differential scanning calorimetric analysis, C represents the mass ratio (%) of the crystalline resin in the resin mixture A, ΔH(B) represents an exothermic quantity (J/g) of an exothermic peak of a resin mixture B in differential scanning calorimetric analysis, the resin mixture B consisting of the amorphous resin B and the crystalline resin and D represents the mass ratio (%) of the crystalline resin in the resin mixture B).

The present invention is also a method for producing a toner described above, wherein the method has steps of:

forming, in an aqueous medium, a particle of a monomer composition that contains the crystalline resin, the amorphous resin B, and a monomer capable of forming the amorphous resin A; and obtaining a toner particle by polymerizing the monomer present in the particle of the monomer composition.

Further features of the present invention will become apparent from the following description of exemplary embodiments.

DESCRIPTION OF THE EMBODIMENTS

Considering this background, the present inventors thought that a satisfactory compatibility between the crystalline resin and the binder resin (amorphous resin A) would be critical for a full expression of the low-temperature fixing effect generated by the crystalline resin. In the course of their investigations, the present inventors discovered that the functional effects of the crystalline resin reside in a lowering of the melt viscosity of the toner as a whole that results from the melted crystalline resin being compatible with the binder resin and plasticizing the binder resin. In the case of the combination of a binder resin and a crystalline resin that exhibits a low compatibility, not only is the melt viscosity of the toner not lowered, but a portion of the crystalline resin ends up also undergoing phase separation during toner melting. When this phenomenon occurs, the overall toner does not melt uniformly and a cold offset phenomenon ends up being readily produced. This cold offset phenomenon is a phenomenon in which a portion of the image undergoes melt adhesion to the fixing roller side and blank dot regions end up being produced in the image.

Thus, a satisfactory compatibility between the crystalline resin and the binder resin, while supporting a satisfactory lowering of the viscosity, is at the same time also crucial from the standpoint of maintaining a cold offset-resistance capability, and it is thought that, by controlling this compatibility, the effects exercised by the crystalline resin could for the first time be fully exploited.

In addition, the present inventors thought that, when a crystalline resin is added, a satisfactory phase separation between the crystalline resin and the shell material would also be critical for obtaining an excellent developing performance.

During the course of their investigations, the present inventors discovered that when a crystalline resin has been added, by causing phase separation between the crystalline resin and the shell material that forms the toner surface, a high glass transition temperature can be maintained for the shell material and a hard toner surface can then be maintained. It is thought that a hard toner surface brings about a high flowability by the toner, and as a result the application of stress from members such as, e.g., the developing roller, is restrained and toner cracking and collapse are then suppressed. As a result, an excellent developing performance can be obtained while the low-temperature fixing effect generated by the crystalline resin is satisfactorily expressed.

As has been indicated in the preceding, in order to obtain an excellent developing performance while fully exploiting the low temperature fixing effect generated by the crystalline resin, both the compatibility between the crystalline resin and the binder resin and the compatibility between the crystalline resin and the shell material must be simultaneously controlled. Here, "crystalline resin" denotes a resin for which a clear endothermic peak (melting point) is observed in the curve for the change in the reversible specific heat as provided by measurement of the change in the specific heat using a differential scanning calorimeter.

For example, a block polymer in which the crystalline resin composition is functionally separated is favorably used in order to carry out the control indicated above. By executing the crystalline resin as a block polymer with a resin having a composition near to that of the binder resin, it is then possible to raise only the compatibility with the binder resin without significantly changing the compatibility with the shell material. That is, the compatibility between the crystalline resin and the binder and the compatibility between the crystalline resin and shell material can be separately and individually controlled.

The aforementioned compatibilities can be achieved, for example, by a method in which the compositions of the binder resin and shell material and the properties of the crystalline resin—e.g., the composition and molecular weight of the crystalline resin, the resin ratios when executed as a block polymer, and so forth—are controlled.

A block polymer is generally defined as a polymer composed of a plurality of linearly connected blocks (Glossary of Basic Terms in Polymer Science by the Commission on Macromolecular Nomenclature of the International Union of Pure and Applied Chemistry, The Society of Polymer Science, Japan), and the present invention also adopts this definition. There are no limitations on the method for producing this block polymer, and it can be produced by known methods.

The present invention is a toner including a toner particle having a core-shell structure that comprises a core containing an amorphous resin A and a crystalline resin and a shell containing an amorphous resin B, and at least 50% by mass of the amorphous resin A is a styrene-acrylic resin.

The amorphous resin A denotes the binder resin in the toner of the present invention. By having at least 50% by mass of the amorphous resin A be a styrene-acrylic resin, a toner having an excellent toner hardness and an excellent charging performance in high-humidity environments is obtained and an excellent developing performance is obtained. The content of the styrene-acrylic resin, expressed with reference to the total mass of the amorphous resin A, is preferably at least 50% by mass and not more than 100% by mass and is more preferably at least 80% by mass and not more than 100% by mass.

The degree of compatibility A between the amorphous resin A and the crystalline resin is at least 50% and not more than 100%. A degree of compatibility A of at least 50% means that the compatibility when melted between the crystalline resin and the amorphous resin A is satisfactorily high. By having the degree of compatibility A be at least 50% and not more than 100%, it is possible to lower the melt viscosity of the toner while maintaining the cold offset-resistance capability, as referenced above, and thus to obtain an excellent low-temperature fixability. When the degree of compatibility A is less than 50%, an excellent low-temperature fixability is not obtained and in particular cold offset readily occurs. The degree of compatibility A is more preferably at least 65% and not more than 100%.

The degree of compatibility B between the amorphous resin B and the crystalline resin is at least 0% and not more than 40%. The amorphous resin B refers to the shell material in the toner of the present invention. A degree of compatibility B of not more than 40% indicates that the compatibility when melted between the crystalline resin and the amorphous resin B is satisfactorily low. Within the indicated range, the crystalline resin undergoes a satisfactory crystallization during the cooling step and due to this the glass transition temperature of the amorphous resin B does not undergo a substantial reduction. An excellent developing performance can be obtained as result. When the degree of compatibility B is larger than 40%, the glass transition temperature of the amorphous resin B declines and due to this the toner flowability declines and an excellent developing performance is not obtained. The degree of compatibility B is more preferably at least 0% and not more than 30%.

These degrees of compatibility can be controlled through the properties of the amorphous resin A, the amorphous resin B, and the crystalline resin, e.g., the composition, molecular weight, and so forth. In particular, the degree of compatibility B between the crystalline resin and the amorphous resin B is conveniently controlled through the composition of the amorphous resin B, and this is thus preferred. The method for measuring these degrees of compatibility is described below.

The crystalline resin is preferably a block polymer in which a crystalline polyester segment is bonded to an amorphous vinyl polymer segment. A high crystallinity can be maintained due to the presence of the crystalline polyester segment. In addition, a high degree of compatibility A can be brought about by having an amorphous vinyl polymer segment bonded to the crystalline polyester segment. By doing this, the degree of compatibility A can be even more conveniently controlled, and as a consequence the degree of compatibility A can be controlled to be larger and the degree of compatibility B can be controlled to be lower.

A known vinyl monomer, e.g., styrene, methyl methacrylate, n-butyl acrylate, and so forth, can be used for the composition of the amorphous vinyl polymer segment. In particular, when at least 50% by mass of the amorphous vinyl polymer segment is styrene, a more preferred configuration is obtained from the standpoint of the compatibility with an amorphous resin A in which the major component is a styrene-acrylate resin. There are no particular limitations on the method for producing the resin in which a crystalline polyester segment is bonded to an amorphous vinyl polymer segment, and known methods may be used. This may be a procedure in which the amorphous vinyl polymer segment is bonded after the crystalline polyester segment has been produced, or may be a procedure in which the crystalline polyester segment is bonded after the amorphous vinyl polymer segment has been produced.

The mass ratio between the crystalline polyester segment and the amorphous vinyl polymer segment is preferably in the range from at least 30/70 to not more than 70/30. A high crystallinity can be maintained for the crystalline resin by having this ratio be at least 30/70, and as a consequence the compatibility with the shell is reduced and an even better developing performance can be obtained. In addition, by having this ratio be not more than 70/30, the degree of compatibility A can be satisfactorily increased and an excellent low-temperature fixability can be obtained. This mass ratio is more preferably from at least 30/70 to not more than 65/35.

In the present invention, the degree of compatibility A declines and the degree of compatibility B increases as the mass ratio of the crystalline polyester segment increases. However, since the crystallinity of the crystalline resin increases at the same time, these degrees of compatibility are preferably controlled considering the behaviors. This mass ratio can be controlled using the monomer charge amounts and reaction conditions when the crystalline resin is produced. The method for measuring this mass ratio is described below.

The crystalline resin preferably has a unit given by the following formula (1) and a unit given by the following formula (2).

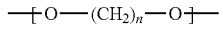

(1)

[in formula (1), n represents an integer that is at least 6 and not more than 16 (preferably at least 6 and not more than 12)]

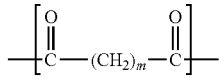

(2)

[in formula (2), m represents an integer that is at least 6 and not more than 14 (preferably at least 6 and not more than 12)]

The crystallinity of the crystalline resin can be increased by the presence of the units given by formula (1) and formula (2), and due to this the degree of compatibility B can be lowered. An even better developing performance can be obtained as a result. The crystallinity of the crystalline resin can be increased by having n, which is the number of carbons in the alcohol monomer, be at least 6. The degree of compatibility A can be further increased by having this n be not more than 16. This n is more preferably at least 6 and not more than 12. For the same reasons, m, which is the number of carbons in the acid monomer, is preferably at least 6 and not more than 14 and is more preferably at least 6 and not more than 12. The composition of the crystalline resin can be controlled through the type of monomer used to produce the crystalline resin. The method for measuring the composition of the crystalline resin is described below.

When the crystalline resin is a block polymer, the content of the units given by formula (1) and formula (2) is preferably at least 50 moil and not more than 100 mol % with reference to the total monomer units used in the polyester segment. When the crystalline resin is a crystalline polyester (homopolymer), the content of the units given by formula (1) and formula (2) is preferably at least 50 mol % and not more than 100 mol % with reference to the total monomer units used in the crystalline polyester. Here, "monomer unit" refers to the reacted state of the monomer substance in the polymer.

The amorphous resin B preferably has at least 0.1 mol % and not more than 30.0 mol %, with reference to the overall monomer-derived units, of the isosorbide unit given in formula (3) below.

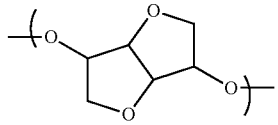

(3)

The degree of compatibility B can be lowered by having the isosorbide unit be in the indicated range. In particular, the degree of compatibility B can be controlled to low values even when the amorphous resin B has a low molecular weight. By having a content of at least 0.1 mol %, a satisfactorily low degree of compatibility B can be obtained, and due to this a better developing performance is then obtained. At not more than 30.0 mol %, the hardness of the amorphous resin B and the charging performance can be satisfactorily maintained even in a high-humidity environment, and due to this an even better developing performance can be obtained. The content of the isosorbide unit is more preferably at least 0.1 mol % and not more than 15.0 mol %. The content of the isosorbide unit can be controlled using the type of monomer used to produce the amorphous resin B. When, for example, the amorphous resin B is a polyester resin, isosorbide may be used as a monomer. The method for measuring the isosorbide unit content is described below.

An ethylene oxide adduct on bisphenol A is also advantageously used as a monomer used to produce the amorphous resin B. The degree of compatibility B can also be controlled through the addition of this monomer.

The method for producing the toner of the present invention preferably has the following steps: a step of forming, in an aqueous medium, a particle of a monomer composition that contains the crystalline resin, the amorphous resin B, and a monomer capable of forming the amorphous resin A; and a step of obtaining a toner particle by polymerizing the monomer present in the particle of the monomer composition. A toner production method that has such steps is referred to as a suspension polymerization method. A toner particle in which the core-shell structure is more clearly realized is obtained when the toner particle is produced by the suspension polymerization method. This is thought to be due to the amorphous resin B, which is the shell material, selectively undergoing phase separation in the initial stage of the polymerization when the monomer composition particle has a low viscosity.

The weight-average molecular weight (Mw) of the crystalline resin is preferably at least 10,000 and not more than 35,000. The degree of compatibility B can be further lowered at 10,000 and above. In addition, the degree of compatibility A can be further raised at not more than 35,000. The Mw of the crystalline resin is more preferably at least 16,000 and not more than 35,000 and is still more preferably at least 20,000 and not more than 35,000.

The weight-average molecular weight (Mw) of the amorphous resin B is preferably at least 10,000 and not more than 18,000. The amorphous resin B can maintain a satisfactory strength even in high-humidity environments at 10,000 and above, and as a consequence an excellent developing performance can be obtained for the toner. In addition, a core-shell structure that resists impairment of the low-temperature fixability can be formed at not more than 18,000.

The weight-average molecular weight (Mw) of the amorphous resin A is preferably at least 8,000 and not more than 100,000.

The method for measuring the weight-average molecular weight (Mw) of the crystalline resin, amorphous resin B, and amorphous resin A is described below.

The content of the crystalline resin in the toner particle in the toner of the present invention is preferably at least 3.0% by mass and not more than 20.0% by mass. Within this range, a satisfactory developing performance can be obtained while obtaining the low-temperature fixing effect generated by the addition of the crystalline resin. In particular, by using not more than 20.0% by mass, the potential for influencing each of the degrees of compatibility specified for the present invention is kept low. The content of the crystalline resin is more preferably at least 5.0% by mass and not more than 15.0% by mass. The method for measuring the content of the crystalline resin is described below.

The content of the amorphous resin A in the toner particle is preferably at least 50% by mass and not more than 95% by mass.

The content of the amorphous resin B in the toner particle is preferably at least 1% by mass and not more than 20% by mass.

The acid value of the amorphous resin B is preferably at least 2.0 mg KOH/g and not more than 15.0 mg KOH/g. A more distinct core-shell structure can be formed when this acid value is at least 2.0 mg KOH/g, particularly in the case of production methods such as the suspension polymerization method. In addition, at not more than 15.0 mg KOH/g, the properties of the amorphous resin B can be maintained even in high-humidity environments and as a consequence an even better developing performance can be obtained for the toner. When the amorphous resin B is a styrene-acrylic resin, in some cases the acid value will also exercise an influence on the degree of compatibility B. The method for measuring the acid value is described below.

The method for producing the toner particle of the present invention is specifically described herebelow using examples of the procedure and the materials that can be used, but this should not be taken as a limitation to the following.

The method for producing the toner of the present invention may be any production method, but the following description concerns a production method that uses suspension polymerization, which is the most preferred procedure.

The amorphous resin B, crystalline resin, and monomer that will form the amorphous resin A, which is the binder resin for the toner particle, are combined and a monomer composition is prepared by melting, dissolving, or dispersing these using a disperser such as a homogenizer, ball mill, colloid mill, ultrasound disperser, and so forth. At this point, the following can be added as appropriate on an optional basis to the monomer composition: release agent, colorant, polar resin, polyfunctional monomer, pigment dispersing agent, charge control agent, solvent for viscosity adjustment, and other additives (for example, a chain extension agent).

This monomer composition is then introduced into a preliminarily prepared aqueous medium containing a dispersion stabilizer, and suspension and granulation are carried out using a high-speed disperser, e.g., a high-speed stirrer or an ultrasound disperser.

A polymerization initiator may be mixed in combination with the other additives during preparation of the monomer composition or may be mixed into the monomer composition immediately before suspension in the aqueous medium. In addition, it may also be added, as necessary dissolved in monomer or dissolved in another solvent, during granulation or after the completion of granulation, i.e., immediately before the initiation of the polymerization reaction.

After granulation, the suspension is heated and an aqueous dispersion of toner particles is formed by carrying out and completing the polymerization reaction while stirring in such a manner that the particles of the monomer composition in the suspension maintain their particulate form and the occurrence of flotation and sedimentation of the particles does not occur, and as necessary by carrying out a solvent removal process.

Subsequent to this, a toner can be obtained by performing washing as necessary and carrying out drying, classification, and an external addition treatment by various methods.

Radically polymerizable vinyl monomers can be used for the monomer that constitutes the styrene-acrylic resin and the amorphous vinyl polymer segment of the crystalline resin that are used in the present invention. Monofunctional monomer or polyfunctional monomer can be used as this vinyl monomer. The styrene-acrylic resin and the vinyl polymer will be considered concurrently in the present invention.

The monofunctional monomer can be exemplified y the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional monomer or a combination of two or more monofunctional monomers may be used for this monomer; a combination of monofunctional monomer with polyfunctional monomer may be used for this monomer; or a single polyfunctional monomer or a combination of two or more polyfunctional monomers may be used for this monomer.

The styrene-acrylic resins, acrylic resins, methacrylic resins, polyester resins, and urethane resins ordinarily used as binder resins for toners can be used as the polymer constituting the amorphous resin B in the present invention. However, the amorphous resin B preferably contains at least a polyester resin from the standpoint of the design of the core-shell structure. The content of the polyester resin in the amorphous resin B is preferably at least 50% by mass and not more than 100% by mass.

The polyester resin constituting the amorphous resin B and the crystalline polyester segment of the crystalline resin that are used in the present invention can be obtained by the reaction of a diol and a polybasic carboxylic acid. When a polyester resin is used as the crystalline resin, the polyester resin provided by the conversion to the polymer of the monomers provided as examples in the following is then limited to polyester resins that exhibit a clear endothermic peak in differential scanning calorimetric measurement (DSC measurement). The method for performing DSC measurement on the various resins is described below.

Known alcohol monomers can be used as the alcohol monomer for obtaining the polyester resin under consideration. For example, the following can specifically be used: alcohol monomers such as ethylene glycol, diethylene glycol, and 1,2-propylene glycol; dihydric alcohols such as polyoxyethylenated bisphenol A; aromatic alcohols such as 1,3,5-trihydroxymethylbenzene; and trihydric alcohols such as pentaerythritol. Among the preceding, the use of at least a polyoxyethylenated bisphenol A is more preferred in particular from the standpoint of the developing performance.

Known carboxylic acid monomers can be used as the carboxylic acid monomer for obtaining this polyester resin. For example, the following can specifically be used: dicarboxylic acids such as oxalic acid, sebacic acid, terephthalic acid, and isophthalic acid as well as the anhydrides and lower alkyl esters of these acids; and an at least tribasic polybasic carboxylic acid component such as trimellitic acid, 2,5,7-naphthalenetricarboxylic acid, 1,2,4-naphthalenetricarboxylic acid, pyromellitic acid, 1,2,4-butanetricarboxylic acid, 1,2,5-hexanetricarboxylic acid, and 1,3-dicarboxyl-2-methyl-2-methylenecarboxypropane as well as their derivatives such as the acid anhydrides and lower alkyl esters. Among the preceding, the use of at least an aromatic dicarboxylic acid, e.g., terephthalic acid, isophthalic acid, and so forth, is more preferred in particular from the standpoint of the developing performance.

The toner of the present invention may contain a colorant. A known colorant can be used as this colorant, e.g., the various heretofore known dyes and pigments.

The black colorant may be a carbon black, a magnetic body, or a black colorant provided by color mixing to yield black using the yellow/magenta/cyan colorants described in the following. For example, the following colorants may be used as colorants for cyan toners, magenta toners, and yellow toners.

For pigment-based yellow colorants, compounds as typified by monoazo compounds, disazo compounds, condensed azo compounds, isoindolinone compounds, anthraquinone compounds, azo-metal complexes, methine compounds, and allylamide compounds may be used. Specific examples are C. I. Pigment Yellow 74, 93, 95, 109, 111, 128, 155, 174, 180, and 185.

Monoazo compounds, condensed azo compounds, diketopyrrolopyrrole compounds, anthraquinone, quinacridone compounds, basic dye lake compounds, naphthol compounds, benzimidazolone compounds, thioindigo compounds, and perylene compounds may be used as the magenta colorant. Specific examples are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C. I. Pigment Violet 19.

Copper phthalocyanine compounds and derivatives thereof, anthraquinone compounds, and basic dye lake compounds can be used as the cyan colorant. Specific examples are C. I. Pigment Blue 1, 7, 15, 15:1, 15:2, 15:3, 15:4, 60, 62, and 66.

The content of the colorant in the toner is preferably at least 1.0% by mass and not more than 20.0% by mass.

A magnetic body may be incorporated in the toner particle when the toner of the present invention is used as a magnetic toner. In this case the magnetic body can also assume the role of a colorant. For the present invention, this magnetic body can be exemplified by iron oxides such as magnetite, hematite, and ferrite and by metals such as iron, cobalt, and nickel. Or, this magnetic body can be exemplified by alloys and mixtures of these metals with metals such as aluminum, cobalt, copper, lead, magnesium, tin, zinc, antimony, beryllium, bismuth, cadmium, calcium, manganese, selenium, titanium, tungsten, and vanadium.

Release agents usable in the present invention can be known release agents without particular limitation. The following compounds are examples: aliphatic hydrocarbon waxes, e.g., low molecular weight polyethylene, low molecular weight polypropylene, microcrystalline wax, paraffin wax, and Fischer-Tropsch waxes; oxides of aliphatic hydrocarbon waxes, such as oxidized polyethylene wax, and their block copolymers; waxes in which the major component is fatty acid ester, such as carnauba wax, sasol wax, ester wax, and montanic acid ester waxes; waxes provided by the partial or complete deacidification of fatty acid esters, such as deacidified carnauba wax; waxes provided by grafting an aliphatic hydrocarbon wax using a vinyl monomer such as styrene or acrylic acid; partial esters between a polyhydric alcohol and a fatty acid, such as behenic monoglyceride; and hydroxyl group-containing methyl ester compounds obtained by, for example, the hydrogenation of plant oils. The release agent is preferably incorporated in the toner particle at at least 1.0% by mass and not more than 20.0% by mass.

The toner particle of the present invention may also use a charge control agent. Among charge control agents, the use is preferred of a charge control agent that controls the toner particle to a negative charging behavior. The charge control agent can be exemplified by the following.

Examples here are organometal compounds, chelate compounds, monoazo metal compounds, acetylacetone-metal compounds, urea derivatives, metal-containing salicylic acid compounds, metal-containing naphthoic acid compounds, quaternary ammonium salts, calixarene, silicon compounds, and nonmetal carboxylic acid compounds and derivatives thereof. In addition, sulfonic acid resins bearing the sulfonic acid group, sulfonate salt group, or sulfonate ester group can preferably be used.

With regard to the amount of addition of the charge control agent, the toner particle preferably contains at least 0.01% by mass and not more than 20.0% by mass.

With regard to the dispersion stabilizer added to the aqueous medium, inorganic dispersing agents are favorably used because they suppress the production of ultrafine powder, are easily washed out, and resist exercising negative effects on the toner. The inorganic dispersing agents can be exemplified by the following: polyvalent metal salts of phosphoric acid, e.g., tricalcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina. These inorganic dispersing agents can be almost completely removed by dissolution through the addition of acid or alkali after the completion of polymerization.

A flowability improver (external additive) is preferably externally added to the toner of the present invention in order to improve the image quality. Silicic acid fine powder and inorganic fine powders of, e.g., titanium oxide, aluminum oxide, and so forth, are favorably used as this flowability improver. These inorganic fine powders are preferably subjected to a hydrophobic treatment with a hydrophobic agent, e.g., a silane coupling agent, silicone oil, or their mixture. An external additive other than a flowability improver may as necessary also be mixed into the toner particle in the toner of the present invention.

The total amount of addition of inorganic fine particles is preferably at least 1.0 parts by mass and not more than 5.0 parts by mass per 100.0 parts by mass of the toner particle.

The toner of the present invention can be used as such as a single-component developer or may be mixed with a magnetic carrier and used as a two-component developer.

The methods for measuring the various properties stipulated for the present invention are described in the following.

<Method for Measuring Degree of Compatibility a Between Crystalline Resin and Amorphous Resin a and Degree of Compatibility B Between Crystalline Resin and Amorphous Resin B>

Measurement by differential scanning calorimetry (DSC) is used to measure the degree of compatibility A and the degree of compatibility B. A resin mixture A prepared by mixing the amorphous resin A and the crystalline resin and a resin mixture B prepared by mixing the amorphous resin B and the crystalline resin are used as the samples.

(Production of Amorphous Resin A)

When the toner particle in the present invention is produced by the suspension polymerization method, separation of only the amorphous resin A from the toner particle is then quite problematic. Due to this, resin corresponding to the amorphous resin A in the particular toner particle must be produced separately.

Specifically, in those instances in which a toner particle is produced by the suspension polymerization method as described above, the amorphous resin A for the particular toner is taken to be the resin produced using only the monomer constituting the amorphous resin A and using the same polymerization temperature and the same amount of the same polymerization initiator as in the production conditions for the toner particle. With regard to whether the identical resin has been obtained, the compositional analysis and measurement of the weight-average molecular weight (Mw) as described below are carried out to confirm identity with the amorphous resin A in the toner particle.

(Production of the Resin Mixture a of the Amorphous Resin a and Crystalline Resin and the Resin Mixture B of the Amorphous Resin B and Crystalline Resin)

The amorphous resin A and the crystalline resin are dissolved in 2 mL of toluene in the same mass ratio as in the production of the particular toner particle and as necessary heating is carried out to produce a uniform solution (the mass ratio between the amorphous resin A and the crystalline resin is 9:1 in the present invention). The solution is heated to 120° C. in a rotary evaporator and the pressure is gradually reduced without bumping. The pressure is reduced to 50 mbar and drying is carried out for 2 hours to obtain the resin mixture A.

The resin mixture B of the amorphous resin B and the crystalline resin was produced by the same procedure as the procedure described above at a mass ratio between the amorphous resin B and the crystalline resin of 8:2. The reason for setting the mass ratio between the amorphous resin B and the crystalline resin at 8:2 is as follows: when mixing is carried out at the 1:2 proportion that is the same ratio as in the various toner particles in the examples in the present application, the crystalline resin becomes saturated in the amorphous resin B and the excess undergoes crystallization, and as a result, even the originally compatibilized crystalline resin is recrystallized.

(Measurement of the Degree of Compatibility a and the Degree of Compatibility B)

The degree of compatibility A and the degree of compatibility B are measured based on ASTM D 3418-82 using a "Q1000" (TA Instruments) differential scanning calorimeter.

The melting points of indium and zinc are used for temperature correction in the instrument detection section, and the heat of fusion of indium is used for correction of the amount of heat. Specifically, 2 mg of the measurement sample is exactly weighed and is introduced into an aluminum pan. Using an empty aluminum pan for reference, heating is carried out in the measurement range from 0° C. to 100° C. at a ramp rate of 10° C./minute. After holding for 15 minutes at 100° C., cooling is carried out at a ramp down rate of 10° C./minute from 100° C. to 0° C. The exothermic quantity ΔH (J/g) of the exothermic peak in the exothermic curve for this cooling process is measured.

The degree of compatibility A (%) was calculated with the following formula using the measured ΔH(C) (J/g) for the crystalline resin and ΔH(A) (J/g) for the resin mixture A provided by mixing the amorphous resin A and the crystalline resin and the mass ratio C (%) of the crystalline resin in the resin mixture A provided by mixing the amorphous resin A and crystalline resin.

$$\text{degree of compatibility } A = 100 - (100 \times \Delta H(A))/(\Delta H(C) \times C/100)$$

The degree of compatibility B (%) was similarly calculated. That is, the degree of compatibility B (%) was calculated with the following formula using the measured ΔH(C) (J/g) for the crystalline resin and ΔH(B) (J/g) for the resin mixture B provided by mixing the amorphous resin B and the crystalline resin at a mass ratio of 8:2 and the mass ratio D (%) of the crystalline resin in the resin mixture B provided by mixing the amorphous resin B and crystalline resin.

$$\text{degree of compatibility } B\ (\%) = 100 - (100 \times \Delta H(B))/(\Delta H(C) \times D/100)$$

<Method for Measuring Mass Ratio Between Crystalline Polyester Segment and Amorphous Vinyl Polymer Segment in Crystalline Resin, Composition of Crystalline Resin, Composition of Amorphous Resin A, Content of Isosorbide Unit Present in Amorphous Resin B, and Crystalline Resin Content>

The compositions, compositional ratios, and contents for each resin is measured using nuclear magnetic resonance spectroscopic analysis ($^1$H-NMR) [400 MHz, $CDCl_3$, room temperature (25° C.)].

measurement instrumentation: JNM-EX400 FT-NMR instrument (JEOL Ltd.)
measurement frequency: 400 MHz
pulse condition: 5.0 μs
frequency range: 10500 Hz
number of integrations: 64

The compositions, compositional ratios, and contents for each resin is calculated from the integration values in the obtained spectra.

<Method for Measuring Weight-Average Molecular Weight (Mw) of Crystalline Resin, Amorphous Resin A, and Amorphous Resin B>

The weight-average molecular weight (Mw) of the crystalline resin, amorphous resin A, and amorphous resin B are measured using gel permeation chromatography (GPC) as follows.

First, the particular resin is dissolved in tetrahydrofuran (THF) at room temperature. The obtained solution is filtered with a "Sample Pretreatment Cartridge" (TOSOH CORPORATION) solvent-resistant membrane filter having a pore diameter of 0.2 μm to obtain a sample solution. The sample solution is adjusted to a concentration of THF-soluble component of 0.8% by mass. Measurement is carried out under the following conditions using this sample solution.

instrument: "HLC-8220GPC" high-performance GPC instrument [TOSOH CORPORATION]
column: 2×LF-604 [SHOWA DENKO K.K.]
eluent: THF
flow rate: 0.6 mL/minute
oven temperature: 40° C.
sample injection amount: 0.020 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", TOSOH CORPORATION) is used to determine the molecular weight of the sample.

<Method for Measuring Acid Value of Amorphous Resin B>

The acid value of the resin is measured in accordance with JIS K 1557-1970. The specific measurement method is described in the following.

2 g of the pulverized sample is exactly weighed (W (g)). The sample is introduced into a 200-mL Erlenmeyer flask; 100 mL of a toluene/ethanol (2:1) mixed solvent is added; and dissolution is carried out for 5 hours. A phenolphthalein solution is added as indicator. The solution is titrated using a burette and using a standard 0.1 mol/L alcoholic KOH solution. The amount of KOH solution used here is designated S (mL). A blank test is performed and the amount of KOH solution used in this case is designated B (mL). The acid value is calculated using the following formula. The "f" in the formula is the factor for the KOH solution.

$$\text{acid value (mg KOH/g)} = [(S-B) \times f \times 5.61]/W$$

<Method for Measuring Melting Point Tm (° C.) of Crystalline Resin and Glass Transition Temperature Tg (° C.) of Amorphous Resin B>

The melting point Tm (° C.) of the crystalline resin and the glass transition temperature Tg (° C.) of the amorphous resin B are measured according to ASTM D 3418-82 using a "Q1000" differential scanning calorimeter (TA Instruments). Temperature correction in the instrument detection section is carried out using the melting points of indium and zinc, and correction of the amount of heat is carried out using the heat of fusion of indium. Specifically, 2 mg of the measurement sample is exactly weighed and is introduced into an aluminum pan. Using an empty aluminum pan for reference, the temperature is raised at a ramp rate of 10° C./minute in the measurement range between 0° C. and 100° C. Holding is carried out for 15 minutes at 100° C. followed by cooling from 100° C. to 0° C. at a ramp down rate of 10° C./minute. Holding at 0° C. is carried out for 10 minutes followed by performing the measurement at a ramp rate of 10° C./minute between 0° C. and 100° C. The melting point Tm (° C.) is taken to be the peak value in the endothermic curve in this second heating process. The Tg (° C.) is taken to be the point at the intersection between the differential heat curve and the line for the midpoint of the baselines for prior to and subsequent to the appearance of the change in the specific heat in the specific heat change curve.

EXAMPLES

The present invention is specifically described in the following using examples, but the present invention is not limited to or by these examples. The parts used in the examples is parts by mass in all instances. Toners 1 to 24 were produced as examples and toners 25 to 33 were produced as comparative examples.

<Production of Crystalline Resin 1>

100.0 parts of sebacic acid and 83.0 parts of 1,9-nonanediol were added to a reactor equipped with a stirrer, thermometer, nitrogen introduction line, water separator, and apparatus for reducing the pressure, and heating was carried out to a temperature of 130° C. while stirring. 0.7 parts of titanium(IV) isopropoxide was added as esterification catalyst followed by heating to a temperature of 160° C. and carrying out a condensation polymerization for 5 hours. After this, the reaction was carried out while heating to a temperature of 180° C. and reducing the pressure, until the desired molecular weight was reached to obtain a polyester (1). Using the previously described methods, the weight-average molecular weight (Mw) of polyester (1) was measured at 15,000 and the melting point (Tm) was measured at 73° C.

100.0 parts of polyester (1) and 440.0 parts of dry chloroform were then added to a reactor equipped with a stirrer, thermometer, and nitrogen introduction line, and, after complete dissolution had been carried out, 5.0 parts of triethylamine was added and 15.0 parts of 2-bromoisobutyryl bromide was gradually added with ice cooling. This was followed by stirring for 24 hours at room temperature (25° C.)

The resulting resin solution was gradually converted into droplets in a container holding 550.0 parts of methanol to reprecipitate the polymer fraction, followed by filtration, purification, and drying to obtain a polyester (2).

100.0 parts of the obtained polyester (2), 100.0 parts of styrene, 3.5 parts of copper(I) bromide, and 8.5 parts of pentamethyldiethylenetriamine were then added to a reactor equipped with a stirrer, thermometer, and nitrogen introduction line and a polymerization reaction was run at a temperature of 110° C. while stirring. The reaction was stopped when the desired molecular weight was reached, and the unreacted styrene and the catalyst were removed by reprecipitation with 250.0 parts of methanol, filtration, and purification. Drying was then performed in a vacuum dryer set to 50° C. to obtain a crystalline resin 1 in which a crystalline polyester segment was bonded to an amorphous vinyl polymer segment. Crystalline resin 1 had units with formula (1) and formula (2) that derived from the sebacic acid and 1,9-nonanediol.

<Production of Crystalline Resins 2 to 13>

Crystalline resins 2 to 13, which had a crystalline polyester segment bonded to an amorphous vinyl polymer segment, were obtained proceeding as in the method in Production of Crystalline Resin 1, but changing to the starting materials as shown in Table 1. The obtained crystalline resins had units with formula (1) and formula (2) that derived from the acid monomer and alcohol monomer used in accordance with Table 1.

<Production of Crystalline Resin 14>

50.0 parts of xylene was heated at reflux at 140° C. under a nitrogen atmosphere in a reactor equipped with a stirrer, thermometer, nitrogen introduction line, and apparatus for reducing the pressure. A mixture of 100.0 parts of styrene and 8.6 parts of 2,2'-azobis(methyl isobutyrate) was added to this dropwise over 3 hours, and the reaction was run for an additional 3 hours after completion of the dropwise addition. This was followed by removal of the xylene and residual styrene at 160° C. and 1 hPa to obtain a vinyl polymer (1).

100.0 parts of the obtained vinyl polymer (1), 50.0 parts of xylene as organic solvent, 48.4 parts of sebacic acid, 51.6 parts of 1,12-dodecanediol, and 0.7 parts of titanium(IV) isopropoxide as esterification catalyst were then added to a reactor equipped with a stirrer, thermometer, nitrogen introduction line, water separator, and apparatus for reducing the pressure, and heating was carried out for 5 hours at 160° C. under a nitrogen atmosphere. This was followed by reaction for 4 hours at 180° C. and additionally by reaction at 180° C. and 1 hPa until the desired molecular weight was achieved to obtain crystalline resin 14.

<Production of Crystalline Resin 15>

100.0 parts of sebacic acid and 83.0 parts of 1,9-nonanediol were added to a reactor equipped with a stirrer, thermometer, nitrogen introduction line, water separator, and apparatus for reducing the pressure, and heating was carried out to a temperature of 130° C. while stirring. 0.7 parts of titanium(IV) isopropoxide was added as esterification catalyst followed by heating to a temperature of 160° C. and carrying out a condensation polymerization for 5 hours. After this, while heating to a temperature of 180° C. and reducing the pressure, the reaction was carried out until the desired molecular weight was reached to obtain a crystalline resin 15.

<Production of Crystalline Resin 16>

100.0 parts of sebacic acid and 83.0 parts of 1,9-nonanediol were added to a reactor equipped with a stirrer, thermometer, nitrogen introduction line, water separator, and apparatus for reducing the pressure, and heating was carried out to a temperature of 130° C. while stirring. 0.7 parts of titanium(IV) isopropoxide was added as esterification catalyst followed by heating to a temperature of 160° C. and running a condensation polymerization for 5 hours. After this, while heating to a temperature of 180° C. and reducing the pressure, the reaction was carried out until the desired molecular weight was reached to obtain a crystalline resin 16.

The properties of the obtained crystalline resins 1 to 16 are given in Table 2. For each of crystalline resins 1 to 16, the presence of a clear endothermic peak (melting point) was confirmed in the curve for the change in the reversible specific heat in measurement of the change in the specific heat using a differential scanning calorimeter.

TABLE 1

| | monomer composition of the crystalline polyester segment | | | | monomer composition of the amorphous vinyl polymer segment | |
|---|---|---|---|---|---|---|
| crystalline resin No. | acid monomer | parts | alcohol monomer | parts | vinyl monomer | parts per 100 parts of the crystalline resin segment |
| 1 | sebacic acid | 100.0 | 1,9-nonanediol | 83.0 | styrene | 100.0 |
| 2 | sebacic acid | 100.0 | 1,12-dodecanediol | 106.5 | styrene | 100.0 |
| 3 | sebacic acid | 100.0 | 1,12-dodecanediol | 106.5 | styrene | 55.0 |
| 4 | sebacic acid | 100.0 | 1,9-nonanediol | 83.0 | styrene | 45.0 |
| 5 | sebacic acid | 100.0 | 1,9-nonanediol | 83.0 | styrene | 30.0 |

TABLE 1-continued

| crystalline resin No. | monomer composition of the crystalline polyester segment: acid monomer | parts | alcohol monomer | parts | monomer composition of the amorphous vinyl polymer segment: vinyl monomer | parts per 100 parts of the crystalline resin segment |
|---|---|---|---|---|---|---|
| 6 | sebacic acid | 100.0 | 1,9-nonanediol | 83.0 | styrene | 200.0 |
| 7 | sebacic acid | 100.0 | 1,9-nonanediol | 83.0 | styrene | 250.0 |
| 8 | adipic acid | 100.0 | 1,6-hexanediol | 109.5 | styrene | 55.0 |
| 9 | dodecanedioic acid | 100.0 | 1,12-dodecanediol | 89.0 | styrene | 100.0 |
| 10 | tetradecanedioic acid | 100.0 | 1,12-dodecanediol | 84.0 | styrene | 100.0 |
| 11 | sebacic acid | 100.0 | 1,6-hexanediol | 54.5 | styrene | 100.0 |
| 12 | tetradecanedioic acid | 100.0 | 1,12-dodecanediol | 84.0 | styrene | 45.0 |
| 13 | sebacic acid | 100.0 | 1,9-nonanediol | 83.0 | styrene | 10.0 |

TABLE 2

| crystalline resin No. | weight-average molecular weight Mw | melting point Tm (° C.) | endothermic quantity ΔH (J/g) | crystalline polyester segment/amorphous vinyl polymer segment ratio | polymer type |
|---|---|---|---|---|---|
| 1 | 30000 | 70 | 50 | 50/50 | block polymer |
| 2 | 35000 | 80 | 65 | 50/50 | block polymer |
| 3 | 32000 | 80 | 80 | 65/35 | block polymer |
| 4 | 32000 | 70 | 65 | 70/30 | block polymer |
| 5 | 36000 | 72 | 70 | 75/25 | block polymer |
| 6 | 20000 | 67 | 35 | 30/70 | block polymer |
| 7 | 19000 | 63 | 30 | 28/72 | block polymer |
| 8 | 30000 | 62 | 60 | 65/35 | block polymer |
| 9 | 32000 | 85 | 65 | 50/50 | block polymer |
| 10 | 32000 | 86 | 70 | 50/50 | block polymer |
| 11 | 30000 | 68 | 50 | 50/50 | block polymer |
| 12 | 35000 | 85 | 95 | 70/30 | block polymer |
| 13 | 38000 | 74 | 90 | 90/10 | block polymer |
| 14 | 30000 | 78 | 65 | 50/50 | block polymer |
| 15 | 10000 | 70 | 110 | 100/0 | homopolymer |
| 16 | 15000 | 75 | 120 | 100/0 | homopolymer |

<Production of Amorphous Resin B1>

A mixture was prepared by mixing the starting monomers other than trimellitic anhydride in the molar ratios given in Table 3, and 100.0 parts of this mixture was added to a reactor equipped with a stirrer, thermometer, nitrogen introduction line, water separator, and apparatus for reducing the pressure, and was heated to a temperature of 130° C. while stirring. This was followed by the addition of 0.52 parts of tin di(2-ethylhexanoate) as esterification catalyst, heating to a temperature of 200° C., and running a condensation polymerization over 6 hours. The trimellitic anhydride was added in the molar ratio given in Table 3; introduction was carried out into a polymerization tank equipped with a nitrogen introduction line, water separation line, and stirrer; and a condensation reaction was run at a reduced pressure of 40 kPa until the desired molecular weight was reached to obtain an amorphous resin B1.

<Production of Amorphous Resins B2 to B9>

Amorphous resins B2 to B9 were produced by carrying out the same process as for amorphous resin B1 using the starting monomer charge amounts and polycondensation reaction temperature conditions given in Table 3.

TABLE 3

| amorphous resin No. | charge ratio (molar ratio): acid TPA | IPA | TMA | alcohol BPA(PO) | BPA(EO) | isosorbide | condensation temperature (° C.) | resin properties: content of isosorbide unit (mol %) | acid value (mg KOH/g) | weight-average molecular weight Mw | glass transition temperature (° C.) |
|---|---|---|---|---|---|---|---|---|---|---|---|
| B1 | 1.100 | 1.100 | 0.045 | 1.000 | 1.000 | 0.220 | 200 | 5.0 | 10.5 | 10000 | 75 |
| B2 | 1.100 | 1.100 | 0.045 | 1.330 | 0.670 | 0.220 | 200 | 5.0 | 10.2 | 10000 | 76 |
| B3 | 1.100 | 1.100 | 0.045 | 1.950 | 0.050 | 0.220 | 210 | 5.0 | 10.7 | 12000 | 78 |
| B4 | 1.100 | 1.100 | 0.045 | 1.000 | 1.000 | 0.044 | 200 | 1.0 | 11.8 | 10000 | 75 |
| B5 | 1.100 | 1.100 | 0.045 | 1.000 | 1.000 | 0.005 | 210 | 0.1 | 13.9 | 13000 | 70 |
| B6 | 1.100 | 1.100 | 0.045 | 1.100 | 1.100 | 0.000 | 220 | 0.0 | 9.2 | 18000 | 70 |
| B7 | 1.100 | 1.100 | 0.045 | 0.460 | 1.100 | 0.660 | 200 | 15.0 | 10.8 | 12000 | 79 |
| B8 | 1.100 | 1.100 | 0.045 | 0.000 | 0.900 | 1.320 | 200 | 30.0 | 14.7 | 9000 | 80 |
| B9 | 1.100 | 1.100 | 0.045 | 2.220 | 0.000 | 0.000 | 200 | 0.0 | 10.4 | 10000 | 70 |
| B10 | styrene-acrylic resin indicated in the Production of Amorphous Resin B10 | | | | | | | 0.0 | 30.2 | 20000 | 90 |

The isosorbide referenced in the table is a compound that has the structure given by the following formula (4).

(4)

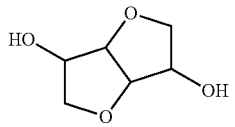

In the table, TPA refers to terephthalic acid; IPA refers to isophthalic acid; TMA refers to trimellitic anhydride; BPA (PO) refers to the 2 mol adduct of propylene oxide on bisphenol A; and BPA(EO) refers to the 2 mol adduct of ethylene oxide on bisphenol A.

<Production of Amorphous Resin B10>

100.0 parts of styrene, 3.0 parts of methyl methacrylate, 5.0 parts of methacrylic acid, 50.0 parts of toluene, and 6.0 parts of t-butyl peroxypivalate were added under a nitrogen atmosphere to a reactor equipped with a reflux condenser, stirrer, thermometer, and nitrogen introduction line. After this, the interior of the reactor was stirred at 200 rpm and polymerization was carried out while heating to 70° C. and continuing to stir for 10 hours. Stirring was carried out for an additional 8 hours with heating to 95° C. and the solvent was removed to obtain an amorphous resin B10.

The properties of the obtained amorphous resins B1 to B10 are given in Table 3.

<Production of Toner 1>

The following starting materials were introduced into a beaker and a mixture was prepared by mixing while stirring at a stirring rate of 100 rpm using a propeller-type stirring apparatus.

| | |
|---|---|
| styrene | 67.5 parts |
| n-butyl acrylate | 22.5 parts |
| Pigment Blue 15:3 | 6.0 parts |
| aluminum salicylate compound (BONTRON E-88: Orient Chemical Industries Co., Ltd.) | 1.0 parts |
| paraffin wax release agent (HNP-9: NIPPON SEIRO CO., LTD., melting point = 75° C.) | 7.0 parts |
| amorphous resin B1 | 5.0 parts |
| crystalline resin 1 | 10.0 parts |

This was followed by heating the mixture to 65° C. to obtain a monomer composition.

800 parts of deionized water and 15.5 parts of tricalcium phosphate were then added to a container equipped with a TK Homomixer high-speed stirrer (PRIMIX Corporation) and the rotation rate was adjusted to 15,000 rpm and heating to 70° C. was carried out to prepare an aqueous medium.

Then, while holding the temperature of the aqueous medium at 70° C. and the rotation rate of the stirrer at 15,000 rpm, the monomer composition was introduced into the aqueous medium and 9.0 parts of the polymerization initiator t-butyl peroxypivalate was added. A granulating step was directly carried out for 20 minutes while maintaining 15,000 rpm with the stirrer. The stirrer was then changed from the high-speed stirrer to a propeller stirring blade; a polymerization was run for 6.0 hours while holding at 70° C. and stirring at 150 rpm to produce a styrene-acrylic resin designated as amorphous resin A; and the solvent and unreacted monomer were removed by raising the temperature to 100° C. and heating for 4 hours.

The slurry was cooled after the completion of the polymerization reaction; hydrochloric acid was added to the cooled slurry to bring the pH to 1.4; and stirring was carried out for 1 hour to dissolve the calcium phosphate salt. The slurry was then washed with 10-fold water followed by filtration, drying, and adjustment of the particle diameter by classification to obtain toner particles. 1.5 parts of a hydrophobic silica fine powder as an external additive (primary particle diameter: 7 nm, BET specific surface area: 130 $m^2/g$), provided by treating a silica fine powder with 20% by mass of a dimethylsilicone oil, was mixed with 100.0 parts of these toner particles for 15 minutes at a stirring rate of 3,000 rpm using a Henschel mixer (MITSUI MIIKE MACHINERY Co., Ltd.) to obtain a toner 1.

<Production of Toners 2 to 20 and 22 to 29>

Toners 2 to 20 and 22 to 29 were obtained proceeding as in the method in Production of Toner but changing the type and number of parts of the monomer, the type of amorphous resin B, and the type of the crystalline resin as shown in Table 4.

TABLE 4

| | monomer | amorphous resin B | crystalline resin No. |
|---|---|---|---|
| toner 1 | styrene 67.5 parts, n-BA22.5 parts | B1 | 1 |
| toner 2 | styrene 67.5 parts, n-BA22.5 parts | B1 | 2 |
| toner 3 | styrene 67.5 parts, n-BA22.5 parts | B1 | 3 |
| toner 4 | styrene 67.5 parts, n-BA22.5 parts | B2 | 1 |
| toner 5 | styrene 67.5 parts, n-BA22.5 parts | B3 | 1 |
| toner 6 | styrene 67.5 parts, n-BA22.5 parts | B1 | 4 |
| toner 7 | styrene 67.5 parts, n-BA22.5 parts | B1 | 5 |
| toner 8 | styrene 67.5 parts, n-BA22.5 parts | B1 | 15 |
| toner 9 | styrene 67.5 parts, n-BA22.5 parts | B1 | 6 |
| toner 10 | styrene 67.5 parts, n-BA22.5 parts | B1 | 7 |
| toner 11 | styrene 67.5 parts, n-BA22.5 parts | B1 | 8 |
| toner 12 | styrene 67.5 parts, n-BA22.5 parts | B1 | 9 |
| toner 13 | styrene 67.5 parts, n-BA22.5 parts | B1 | 10 |
| toner 14 | styrene 67.5 parts, n-BA22.5 parts | B4 | 1 |
| toner 15 | styrene 67.5 parts, n-BA22.5 parts | B5 | 1 |
| toner 16 | styrene 67.5 parts, n-BA22.5 parts | B6 | 1 |
| toner 17 | styrene 67.5 parts, n-BA22.5 parts | B7 | 1 |
| toner 18 | styrene 67.5 parts, n-BA22.5 parts | B8 | 1 |
| toner 19 | styrene 67.5 parts, n-BA22.5 parts | B6 | 2 |
| toner 20 | styrene 67.5 parts, n-BA22.5 parts | B6 | 11 |
| toner 22 | styrene 25.2 parts, t-BA64.8 parts | B1 | 1 |
| toner 23 | styrene 66.6 parts, PA23.4 parts | B1 | 1 |
| toner 24 | styrene 67.5 parts, n-BA22.5 parts | B1 | 14 |
| toner 25 | styrene 67.5 parts, n-BA22.5 parts | B1 | 12 |
| toner 26 | styrene 67.5 parts, n-BA22.5 parts | B1 | 13 |
| toner 27 | styrene 67.5 parts, n-BA22.5 parts | B1 | 16 |
| toner 28 | styrene 67.5 parts, n-BA22.5 parts | B9 | 1 |
| toner 29 | styrene 67.5 parts, n-BA22.5 parts | B9 | 15 |

In the table, t-BA refers to t-butyl acrylate; n-BA refers to n-butyl acrylate; and PA refers to propyl acrylate.

<Production of Toner 21>

(Preparation of an Amorphous Resin A Dispersion)

| | |
|---|---|
| styrene | 75.0 parts |
| n-butyl acrylate | 25.0 parts |

The preceding were mixed and dissolved and then dispersed and emulsified in a solution of 1.5 parts of a nonionic surfactant (Nonipol 400, Sanyo Chemical Industries, Ltd.) and 2.2 parts of an anionic surfactant (Neogen SC, DKS Co. Ltd.) in 120.0 parts of deionized water, and to this was added, while gently mixing for 10 minutes, 1.5 parts of ammonium persulfate as polymerization initiator dissolved in 10.0 parts of deionized water. After substitution with nitrogen, the contents were heated to a temperature of 70° C.

while stirring and emulsion polymerization was continued in this state for 4 hours. After this, the amount of deionized water was adjusted to bring the solids fraction concentration to 20.0% by mass to produce an amorphous resin A dispersion in which an amorphous resin A having an average particle diameter of 0.29 μm was dispersed.

An amorphous resin A5 was obtained by subjecting a portion of this amorphous resin A dispersion to centrifugal separation to recover the solids fraction and then drying the solids fraction.

(Preparation of a Crystalline Resin Dispersion)

| | |
|---|---|
| crystalline resin 1 | 50.0 parts |
| anionic surfactant (Neogen SC) | 7.0 parts |
| deionized water | 200.0 parts |

The preceding were heated to a temperature of 95° C. and were dispersed using a homogenizer (Ultra-Turrax T50, IKA), followed by a dispersion treatment with a pressure-ejection homogenizer. The amount of deionized water was then adjusted to bring the solids fraction concentration to 20.0% by mass, thereby preparing a crystalline resin dispersion in which crystalline resin 1 was dispersed.

(Amorphous Resin B Dispersion)

Amorphous resin B1 (100.0 parts), 50.0 parts of methyl ethyl ketone, 50.0 parts of tetrahydrofuran, and 2.0 parts of dimethylaminoethanol (DMAE) were introduced into a reactor equipped with a stirrer, condenser, thermometer, and nitrogen introduction line and were heated to 50° C. and dissolved.

300.0 parts of deionized water at 50° C. was then added while stirring in order to prepare an aqueous dispersion; the obtained aqueous dispersion was subsequently transferred to a distillation apparatus; and distillation was performed until the fraction temperature reached 100° C.

After cooling, deionized water was added to the obtained aqueous dispersion to adjust the resin concentration in the dispersion to 20.0% by mass. The obtained dispersion of the amorphous resin B1 was designated amorphous resin B dispersion.

(Preparation of Colorant Dispersion)

| | |
|---|---|
| cyan colorant (C.I. Pigment Blue 15:3) | 20.0 parts |
| anionic surfactant (Neogen SC) | 3.0 parts |
| deionized water | 78.0 parts |

The preceding were mixed and were dispersed using a sand grinder mill. After this, the amount of deionized water was adjusted to bring the solids fraction concentration to 20.0% by mass. When the particle size distribution in this colorant dispersion was measured using a particle size analyzer (LA-700, Horiba, Ltd.), the average particle diameter of the incorporated colorant was 0.20 μm and coarse particles in excess of 1.00 μm were not observed.

(Preparation of Wax Dispersion)

| | |
|---|---|
| hydrocarbon wax (HNP-9: NIPPON SEIRO CO., LTD., melting point = 75° C.) | 50.0 parts |
| anionic surfactant (Neogen SC) | 7.0 parts |
| deionized water | 200.0 parts |

The preceding were heated to a temperature of 95° C. and were dispersed using a homogenizer (Ultra-Turrax T50, IKA), followed by a dispersion treatment with a pressure-ejection homogenizer. The amount of deionized water was adjusted to bring the solids fraction concentration to 20.0% by mass, thereby yielding a wax particle dispersion in which wax with an average particle diameter of 0.50 μm was dispersed.

(Preparation of Charge Control Particle Dispersion)

| | |
|---|---|
| metal compound of dialkylsalicylic acid (negative charging control agent, Bontron E-84, Orient Chemical Industries Co., Ltd.) | 5.0 parts |
| anionic surfactant (Neogen SC) | 3.0 parts |
| deionized water | 78.0 parts |

The preceding were mixed and were dispersed using a sand grinder mill. After this, the amount of deionized water was adjusted to bring the solids fraction concentration to 5.0% by mass.

(Mixture Preparation)

| | |
|---|---|
| amorphous resin A dispersion | 90.0 parts |
| amorphous resin B dispersion | 5.0 parts |
| crystalline resin dispersion | 10.0 parts |
| colorant dispersion | 6.0 parts |
| wax dispersion | 7.0 parts |

The preceding were introduced into a 1-liter separable flask fitted with a stirring apparatus, a condenser, and a thermometer and were stirred. This mixture was adjusted to pH=5.2 using 1 mol/L potassium hydroxide.

120.0 parts of an 8.0% by mass aqueous sodium chloride solution was added dropwise as an aggregating agent to the mixture and heating was carried out to a temperature of 55° C. while stirring. When this temperature was reached, 2.0 parts of the charge control particle dispersion was added. The temperature of 55° C. was held for 2 hours followed by observation with an optical microscope, which confirmed that aggregated particles with an average particle diameter of 3.3 μm had been formed.

This was followed by the supplemental addition of 3.0 parts of anionic surfactant (Neogen SC), then heating to a temperature of 95° C. while continuing to stir, and holding for 4.5 hours. The slurry was cooled and then washed with water in an amount 10-fold that of the slurry followed by filtration, drying, and adjustment of the particle diameter by classification to obtain toner particles.

1.5 parts of a hydrophobic silica fine powder as an external additive (primary particle diameter: 7 nm, BET specific surface area: 130 $m^2/g$), provided by treating a silica fine powder with 20% by mass of a dimethylsilicone oil, was mixed for 15 minutes with 100.0 parts of these toner particles using a Henschel mixer at a stirring rate of 3,000 rpm to obtain a toner 21.

<Production of Toners 30 and 31>

A toner 30 was obtained by carrying out production as for toner 21, with the exception that crystalline resin 16 was used in place of crystalline resin 1 in the Production of Toner 21 and amorphous resin B10 was used in place of amorphous resin B1. In addition, a toner 31 was obtained by carrying out production as for toner 21, with the exception that amorphous resin B10 was used in place of amorphous resin B1 in the Production of Toner 21.

<Production of Toner 32>

| | |
|---|---|
| amorphous resin A4 (see below) | 90.0 parts |
| amorphous resin B10 | 5.0 parts |
| crystalline resin 16 | 10.0 parts |
| paraffin wax release agent (HNP-9: NIPPON SEIRO CO., LTD., melting point = 75° C.) | 7.0 parts |
| Pigment Blue 15:3 | 6.0 parts |
| aluminum salicylate compound (Bontron E-88: Orient Chemical Industries Co., Ltd.) | 1.0 parts |
| ethyl acetate | 200.0 parts |

These components were mixed and dispersed for 10 hours using a ball mill; the obtained dispersion was introduced into 2,000 parts of deionized water that contained 3.5% by mass of tricalcium phosphate; and granulation was carried out for 10 minutes using a TK Homomixer at a stirring rate of 15,000 rpm. This was followed by solvent removal by holding for 4 hours at 75° C. on a water bath while stirring at 150 rpm with a Three-One Motor. The slurry was cooled; hydrochloric acid was added to the cooled slurry to bring the pH to 1.4; and stirring was carried out for 1 hour to dissolve the calcium phosphate salt. The slurry was then washed with 10-fold water followed by filtration, drying, and adjustment of the particle diameter by classification to obtain toner particles. 1.5 parts of a hydrophobic silica fine powder as an external additive (primary particle diameter: 7 nm, BET specific surface area: 130 m/g), provided by treating a silica fine powder with 20% by mass of a dimethylsilicone oil, was mixed for 15 minutes with 100.0 parts of these toner particles using a Henschel mixer at a stirring rate of 3,000 rpm to obtain a toner 32.

<Production of Toner 33>

A toner 33 was obtained by carrying out production as in the Production of Toner 32, but using amorphous resin B1 in place of amorphous resin B10 and using crystalline resin 1 in place of crystalline resin 16.

<Production of Amorphous Resins A1 to A3>

Polymerization reactions were carried out using the same production method as for toner 1, toner 22, and toner 23, but without using the Pigment Blue 15:3, release agent, amorphous resin B1, and crystalline resin 1 used in the production method for toner 1, toner 22, and toner 23. The resins provided by cooling, dissolution of the calcium phosphate salt, washing, filtration, and drying were designated amorphous resin A1, amorphous resin A2, and amorphous resin A3, respectively.

<Production of Amorphous Resin A4>

The following starting materials were introduced into a reactor equipped with a stirrer, thermometer, nitrogen introduction line, water separator, and apparatus for reducing the pressure.

| | |
|---|---|
| terephthalic acid | 1.0 mol |
| isophthalic acid | 1.0 mol |
| 2 mol adduct of propylene oxide on bisphenol A | 2.0 mol |

Heating was then carried out to a temperature of 130° C. while stirring; 0.52 parts of tin di(2-ethylhexanoate) was added as esterification catalyst; and heating was carried out to a temperature of 200° C. and a condensation polymerization was run over 6 hours. 0.045 mol of trimellitic anhydride was added; introduction was carried out into a polymerization tank fitted with a nitrogen introduction line, water separation line, and stirrer; and a condensation reaction was run under a reduced pressure of 40 kPa until the desired molecular weight was reached to obtain an amorphous resin A4.

The properties of amorphous resins A1 to A5 are given in Table 5.

TABLE 5

| | weight-average molecular weight Mw | glass transition temperature (° C.) |
|---|---|---|
| amorphous resin A1 | 30000 | 54 |
| amorphous resin A2 | 30000 | 56 |
| amorphous resin A3 | 31000 | 52 |
| amorphous resin A4 | 6000 | 53 |
| amorphous resin A5 | 18000 | 54 |

<Measurement of Degree of Compatibility a and Degree of Compatibility B>

Using the previously described method, the degree of compatibility A and degree of compatibility B were measured for the amorphous resins A, amorphous resins B, and crystalline resins. Table 6 gives the properties of toners 1 to 33 and the results for the degree of compatibility A and the degree of compatibility B.

TABLE 6

| | | toner properties | | corresponding starting materials | | | degree of compatibility (%) | |
|---|---|---|---|---|---|---|---|---|
| | toner No. | Mw | Tg (° C.) | amorphous resin A | amorphous resin B | crystalline resin | degree of compatibility A | degree of compatibility B |
| Example 1 | 1 | 30000 | 49 | A1 | B1 | 1 | 98 | 3 |
| Example 2 | 2 | 30000 | 51 | A1 | B1 | 2 | 80 | 3 |
| Example 3 | 3 | 30000 | 52 | A1 | B1 | 3 | 55 | 3 |
| Example 4 | 4 | 30000 | 49 | A1 | B2 | 1 | 98 | 20 |
| Example 5 | 5 | 30000 | 49 | A1 | B3 | 1 | 98 | 40 |
| Example 6 | 6 | 30000 | 50 | A1 | B1 | 4 | 65 | 25 |
| Example 7 | 7 | 30000 | 51 | A1 | B1 | 5 | 60 | 30 |
| Example 8 | 8 | 30000 | 47 | A1 | B1 | 15 | 60 | 40 |
| Example 9 | 9 | 30000 | 50 | A1 | B1 | 6 | 100 | 30 |
| Example 10 | 10 | 30000 | 49 | A1 | B1 | 7 | 100 | 40 |
| Example 11 | 11 | 30000 | 48 | A1 | B1 | 8 | 90 | 35 |
| Example 12 | 12 | 30000 | 52 | A1 | B1 | 9 | 65 | 0 |
| Example 13 | 13 | 30000 | 52 | A1 | B1 | 10 | 55 | 0 |
| Example 14 | 14 | 30000 | 49 | A1 | B4 | 1 | 98 | 20 |
| Example 15 | 15 | 30000 | 49 | A1 | B5 | 1 | 98 | 25 |
| Example 16 | 16 | 30000 | 49 | A1 | B6 | 1 | 98 | 20 |

TABLE 6-continued

| | toner No. | toner properties Mw | Tg (° C.) | corresponding starting materials amorphous resin A | amorphous resin B | crystalline resin | degree of compatibility (%) degree of compatibility A | degree of compatibility B |
|---|---|---|---|---|---|---|---|---|
| Example 17 | 17 | 30000 | 49 | A1 | B7 | 1 | 98 | 5 |
| Example 18 | 18 | 30000 | 49 | A1 | B8 | 1 | 98 | 10 |
| Example 19 | 19 | 30000 | 51 | A1 | B6 | 2 | 80 | 5 |
| Example 20 | 20 | 30000 | 49 | A1 | B6 | 11 | 100 | 30 |
| Example 21 | 21 | 18000 | 49 | A5 | B1 | 1 | 98 | 3 |
| Example 22 | 22 | 30000 | 51 | A2 | B1 | 1 | 100 | 3 |
| Example 23 | 23 | 30000 | 49 | A3 | B1 | 1 | 90 | 3 |
| Example 24 | 24 | 30000 | 51 | A1 | B1 | 14 | 90 | 3 |
| Comparative Example 1 | 25 | 30000 | 53 | A1 | B1 | 12 | 40 | 10 |
| Comparative Example 2 | 26 | 30000 | 49 | A1 | B1 | 13 | 45 | 20 |
| Comparative Example 3 | 27 | 30000 | 48 | A1 | B1 | 16 | 30 | 40 |
| Comparative Example 4 | 28 | 30000 | 49 | A1 | B9 | 1 | 98 | 50 |
| Comparative Example 5 | 29 | 30000 | 47 | A1 | B9 | 15 | 60 | 100 |
| Comparative Example 6 | 30 | 30000 | 48 | A1 | B10 | 16 | 30 | 100 |
| Comparative Example 7 | 31 | 30000 | 49 | A1 | B10 | 1 | 98 | 75 |
| Comparative Example 8 | 32 | 6500 | 42 | A4 | B10 | 16 | 100 | 100 |
| Comparative Example 9 | 33 | 7000 | 42 | A4 | B1 | 1 | 70 | 3 |

Examples 1 to 24 and Comparative Examples 1 to 9

Each of the obtained toners was subjected to performance evaluations in accordance with the following methods.

[Fixing Performance]

A color laser printer (HP Color Laser Jet 3525dn, HP Development Company, L.P.) from which the fixing unit had been removed was prepared; the toner was removed from the cyan cartridge; and the toner to be evaluated was filled as a replacement. Then, using the filled toner, a 2.0 cm long by 15.0 cm wide unfixed toner image (0.9 mg/cm$^2$) was formed on the image-receiving paper (Office Planner from Canon, Inc., 64 g/m$^2$) at a position 1.0 cm from the top edge considered in the paper transit direction. The removed fixing unit was then modified so the fixation temperature and process speed could be adjusted and was used to conduct a fixing test on the unfixed image.

First, operating in a normal temperature and normal humidity environment (23° C., 60% RH) at a process speed of 230 mm/s and with the lineal fixing pressure set to 27.4 kgf and the initial temperature set to 110° C., the unfixed image was fixed at each temperature level while raising the set temperature sequentially in 5° C. increments.

The evaluation criteria for the low-temperature fixability are given below. The low-temperature-side fixing starting point is defined as the lowest temperature at which, when the surface of the image is rubbed 5 times at a speed of 0.2 m/second with lens cleaning paper (Dusper K-3) loaded with 4.9 kPa (50 g/cm$^2$), image peeling with a diameter of 150 μm or more occurs not more than 3 times. This image peeling increases as fixing occurs less tightly.

(Evaluation Criteria)

A: the low-temperature-side fixing starting point is equal to or less than 115° C. (the low-temperature fixability is particularly excellent)

B: the low-temperature-side fixing starting point is 120° C. or 125° C. (excellent low-temperature fixability)

C: the low-temperature-side fixing starting point is 130° C. or 135° C. (good low-temperature fixability)

D: the low-temperature-side fixing starting point is 140° C. or 145° C. (somewhat poor low-temperature fixability)

E: the low-temperature-side fixing starting point is 150° C. or more (poor low-temperature fixability)

[Developing Performance]

The evaluation was carried out using a commercial color laser printer (HP Color LaserJet 3525dn, HP Development Company, L.P.) that had been modified to operate with just a single color process cartridge installed. The toner in the cyan cartridge installed in this color laser printer was extracted; the interior was cleaned with an air blower; and the toner (300 g) to be evaluated was filled as a replacement. 500 prints of a chart with a 2% print percentage were continuously output at normal temperature and normal humidity (23° C., 60% RH) using Office Planner (64 g/cm$^2$) from Canon, Inc. as the image-receiving paper. After this output run, a halftone image was additionally output and the developing performance was evaluated as indicated below by checking the presence/absence of image streaks in this halftone image and checking the presence/absence of melt-adhered material on the developing roller.

(Evaluation Criteria)

A: Vertical streaks in the discharge direction considered to be development stripes are not seen on the developing roller or on the image in the halftone region. (particularly excellent developing performance)

B: From 1 to 3 thin streaks are present on the developing roller, but vertical streaks in the discharge direction considered to be development stripes are not seen on the image in the halftone region. (excellent developing performance)

C: From 4 to 6 thin streaks are present on the developing roller, but vertical streaks in the discharge direction considered to be development stripes are not seen on the image in the halftone region. (good developing performance)

D: From 7 to 9 thin streaks are present on the developing roller and visible development stripes are seen in the image in the halftone region. (somewhat poor developing performance)

E: Significant development stripes, at least 10, are seen on the developing roller and the image in the halftone region. (poor developing performance)

An evaluation of the developing performance at normal temperature and high humidity (23° C., 80% RH) was also carried out using the same procedure as described above, and the developing performance in a high humidity environment was evaluated using the same criteria for the developing performance as given above.

[Heat Resistance]

5.0 g of the toner was placed in a 100-mL plastic cup; this was held for 10 days at a temperature of 50° C./humidity of 10% RH; and the degree of aggregation of the toner was then measured as described in the following and was evaluated using the criteria given below.

The measurement apparatus used was a "Powder Tester" (Hosokawa Micron Group) that had a "Digi-Vibro MODEL 1332A" (Showa Sokki Corporation) digital display vibration meter connected to a side surface of its vibration table. The following were set on the vibration table of the Powder Tester stacked in the following sequence considered from the bottom: sieve with an aperture of 38 μm (400 mesh), sieve with an aperture of 75 μm (200 mesh), and sieve with an aperture of 150 μm (100 mesh). The measurement was carried out as follows in a 23° C., 60% RH environment.

(1) The vibration amplitude of the vibration table was preliminarily adjusted to provide a value for the displacement according to the digital display vibration meter of 0.60 mm (peak-to-peak).

(2) 5 g of the toner that had been subjected to the aforementioned holding period was exactly weighed and was gently loaded onto the sieve having an aperture of 150 μm, which was the uppermost stage.

(3) The sieves were vibrated for 15 seconds; the mass of the toner remaining on each sieve was then measured; and the degree of aggregation was calculated based on the following formula.

degree of aggregation (%)={(sample mass (g) on the sieve having an aperture of 150 μm)/5 (g)}×100+{(sample mass (g) on the sieve having an aperture of 75 μm)/5 (g)}×100×0.6+{(sample mass (g) on the sieve having an aperture of 38 μm)/5 (g)}×100×0.2

The evaluation criteria are as follows.

A: the degree of aggregation is less than 20% (particularly excellent heat resistance)

B: the degree of aggregation is at least 20% and less than 25% (excellent heat resistance)

C: the degree of aggregation is at least 25% and less than 30% (good heat resistance)

D: the degree of aggregation is at least 30% and less than 35% (somewhat poor heat resistance)

E: the degree of aggregation is at least 35% (poor heat resistance)

The results are given in Table 7.

TABLE 7

| | | fixing performance | | developing performance | | developing performance in a high humidity environment | | heat resistance | |
|---|---|---|---|---|---|---|---|---|---|
| | | low-temperature-side fixing starting point (° C.) | rank | number of streaks on the developing roller | rank | number of streaks on the developing roller | rank | degree of aggregation (%) | rank |
| Example 1 | toner 1 | 115 | A | 0 | A | 0 | A | 10 | A |
| Example 2 | toner 2 | 120 | B | 0 | A | 0 | A | 5 | A |
| Example 3 | toner 3 | 135 | C | 0 | A | 0 | A | 5 | A |
| Example 4 | toner 4 | 115 | A | 1 | B | 1 | B | 10 | A |
| Example 5 | toner 5 | 110 | A | 4 | C | 4 | C | 18 | A |
| Example 6 | toner 6 | 120 | B | 1 | B | 1 | B | 13 | A |
| Example 7 | toner 7 | 130 | C | 3 | B | 3 | B | 12 | A |
| Example 8 | toner 8 | 125 | B | 6 | C | 6 | C | 25 | C |
| Example 9 | toner 9 | 110 | A | 2 | B | 2 | B | 18 | A |
| Example 10 | toner 10 | 110 | A | 4 | C | 4 | C | 19 | A |
| Example 11 | toner 11 | 115 | A | 6 | C | 6 | C | 19 | A |
| Example 12 | toner 12 | 125 | B | 0 | A | 0 | A | 5 | A |
| Example 13 | toner 13 | 135 | C | 0 | A | 0 | A | 5 | A |
| Example 14 | toner 14 | 115 | A | 2 | B | 2 | B | 10 | A |
| Example 15 | toner 15 | 115 | A | 2 | B | 2 | B | 10 | A |
| Example 16 | toner 16 | 115 | A | 2 | B | 2 | B | 10 | A |
| Example 17 | toner 17 | 115 | A | 0 | A | 3 | B | 5 | A |
| Example 18 | toner 18 | 115 | A | 3 | B | 6 | C | 5 | A |
| Example 19 | toner 19 | 120 | B | 0 | A | 0 | A | 5 | A |
| Example 20 | toner 20 | 110 | A | 3 | B | 3 | B | 18 | A |
| Example 21 | toner 21 | 115 | A | 0 | A | 3 | B | 28 | C |
| Example 22 | toner 22 | 115 | A | 0 | A | 0 | A | 10 | A |
| Example 23 | toner 23 | 125 | B | 0 | A | 0 | A | 5 | A |
| Example 24 | toner 24 | 115 | A | 0 | A | 0 | A | 5 | A |
| Comparative Example 1 | toner 25 | 145 | D | 2 | B | 2 | B | 5 | A |
| Comparative Example 2 | toner 26 | 140 | D | 4 | C | 4 | C | 10 | A |
| Comparative Example 3 | toner 27 | 150 | E | 6 | C | 6 | C | 18 | A |
| Comparative Example 4 | toner 28 | 110 | A | 7 | D | 9 | D | 19 | A |
| Comparative Example 5 | toner 29 | 120 | B | 10 | E | 10 | E | 37 | E |

TABLE 7-continued

| | | fixing performance | | developing performance | | developing performance in a high humidity environment | | heat resistance | |
|---|---|---|---|---|---|---|---|---|---|
| | | low-temperature-side fixing starting point (° C.) | rank | number of streaks on the developing roller | rank | number of streaks on the developing roller | rank | degree of aggregation (%) | rank |
| Comparative Example 6 | toner 30 | 150 | E | 12 | E | 15 | E | 31 | D |
| Comparative Example 7 | toner 31 | 130 | C | 7 | D | 13 | E | 25 | C |
| Comparative Example 8 | toner 32 | 130 | C | 15 | E | 15 | E | 34 | D |
| Comparative Example 9 | toner 33 | 125 | B | 6 | C | 15 | E | 26 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-163399, filed Aug. 21, 2015, which is hereby incorporated by reference herein in its entirety.

What is claimed is:

1. A toner comprising a toner particle having a core-shell structure that contains a core and a shell on the core, wherein the core comprises an amorphous resin A and a crystalline resin, the shell comprises an amorphous resin B, the amorphous resin A comprises a styrene-acrylic resin, a content of the styrene-acrylic resin is at least 50% by mass based on the total mass of the amorphous resin A, a degree of compatibility A between the amorphous resin A and the crystalline resin, calculated with the following formula (X), is at least 50% and not more than 100%

$$\text{degree of compatibility } A\ (\%)=100-(100\times\Delta H(A))/(\Delta H(C)\times C/100) \quad \text{(X), and}$$

a degree of compatibility B between the amorphous resin B and the crystalline resin, calculated with the following formula (Y), is at least 0% and not more than 40%

$$\text{degree of compatibility } B\ (\%)=100-(100\times\Delta H(B))/(\Delta H(C)\times D/100) \quad \text{(Y),}$$

wherein, in formulae (X) and (Y),

ΔH(A) represents an exothermic quantity (J/g) of an exothermic peak of a resin mixture A in differential scanning calorimetric analysis, the resin mixture A consisting of the amorphous resin A and the crystalline resin, ΔH(C) represents an exothermic quantity (J/g) of an exothermic peak of the crystalline resin in differential scanning calorimetric analysis, C represents a mass ratio (%) of the crystalline resin in the resin mixture A, ΔH(B) represents an exothermic quantity (J/g) of an exothermic peak of a resin mixture B in differential scanning calorimetric analysis, the resin mixture B consisting of the amorphous resin B and the crystalline resin, and D represents a mass ratio (%) of the crystalline resin in the resin mixture B.

2. The toner according to claim 1, wherein the crystalline resin is a block polymer in which a crystalline polyester segment is bonded to an amorphous vinyl polymer segment.

3. The toner according to claim 2, wherein a mass ratio of the crystalline polyester segment to the amorphous vinyl polymer segment is at least 30/70 and not more than 70/30.

4. The toner according to claim 1, wherein the crystalline resin has a unit represented by the following formula (1) and a unit represented by the following formula (2), and

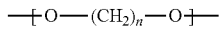

(1)

wherein, in formula (1), n represents an integer that is at least 6 and not more than 16, and

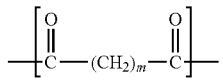

(2)

in formula (2), m represents an integer that is at least 6 and not more than 14.

5. The toner according to claim 1, wherein the amorphous resin B contains at least 0.1 mol % and not more than 30.0 mol %, with respect to the total monomer-derived units, of an isosorbide unit given by the following formula (3)

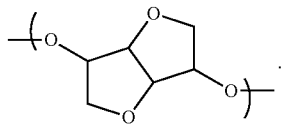

(3)

6. A method for producing a toner comprising a toner particle having a core-shell structure that contains a core and a shell on the core, wherein the core comprises an amorphous resin A and a crystalline resin, the shell comprises an amorphous resin B, the amorphous resin A comprises a styrene-acrylic resin, a content of the styrene-acrylic resin is at least 50% by mass based on the total mass of the amorphous resin A, a degree of compatibility A between the amorphous resin A and the crystalline resin, calculated with the following formula (X), is at least 50% and not more than 100%

$$\text{degree of compatibility } A\ (\%)=100-(100\times\Delta H(A))/(\Delta H(C)\times C/100) \quad \text{(X), and}$$

a degree of compatibility B between the amorphous resin B and the crystalline resin, calculated with the following formula (Y), is at least 0% and not more than 40%

$$\text{degree of compatibility } B\ (\%)=100-(100\times\Delta H(B))/(\Delta H(C)\times D/100) \quad \text{(Y)},$$

(wherein, in formulae (X) and (Y),

ΔH(A) represents an exothermic quantity (J/g) of an exothermic peak of a resin mixture A of the amorphous resin A and the crystalline resin in differential scanning calorimetric analysis, ΔH(C) represents an exothermic quantity (J/g) of an exothermic peak of the crystalline resin in differential scanning calorimetric analysis, C represents a mass ratio (%) of the crystalline resin in the resin mixture A, ΔH(B) represents an exothermic quantity (J/g) of an exothermic peak of a resin mixture B of the amorphous resin B and the crystalline resin in differential scanning calorimetric analysis, and D represents a mass ratio (%) of the crystalline resin in the resin mixture B), and wherein the method comprises steps of:

forming, in an aqueous medium, a particle of a monomer composition that comprises the crystalline resin, the amorphous resin B, and a monomer capable of forming the amorphous resin A; and obtaining a toner particle by polymerizing the monomer present in the particle of the monomer composition.

* * * * *